US006148156A

United States Patent [19]

Matsumoto

[11] Patent Number: 6,148,156

[45] Date of Patent: Nov. 14, 2000

[54] DEVELOPER DETECTION APPARATUS AND AN IMAGE FORMING APPARATUS

[75] Inventor: Yasuhiro Matsumoto, Moriya-machi, Japan

[73] Assignee: Canon Kabushiki Kaisha, Tokyo, Japan

[21] Appl. No.: 09/184,653

[22] Filed: Nov. 3, 1998

[30] Foreign Application Priority Data

Nov. 6, 1997 [JP] Japan ..... 9-320441

[51] Int. Cl.[7] ..... G03G 15/08

[52] U.S. Cl. ..... 399/30; 399/27; 399/63

[58] Field of Search ..... 399/62, 63, 64, 399/65, 125, 30, 107, 27, 110, 111, 119

[56] References Cited

U.S. PATENT DOCUMENTS

| | | | |
|---|---|---|---|
| 4,913,087 | 4/1990 | Saita et al. | 399/62 X |
| 5,166,729 | 11/1992 | Rathbun et al. | 399/63 |
| 5,428,427 | 6/1995 | Lee | 399/30 |
| 5,893,007 | 4/1999 | Lim | 399/27 X |

FOREIGN PATENT DOCUMENTS

| | | |
|---|---|---|
| 0 506 423 | 9/1993 | European Pat. Off. . |
| 3-264974 | 11/1991 | Japan . |
| 6-230674 | 8/1994 | Japan . |

*Primary Examiner*—Susan S. Y. Lee

*Attorney, Agent, or Firm*—Fitzpatrick, Cella, Harper & Scinto

[57] ABSTRACT

A developer detection apparatus includes a detection member for detecting the developer contained in the developer container detachably mountable on a main body of an image forming apparatus. A biasing member biases the detection member to the developer container side. An interlocking mechanism interlocks with open and close operations of the opening and closing cover for attaching the developer container to or detaching the developer container from the main body of the apparatus. In this developer detection apparatus, when the opening and closing cover is in the open state, the detection member is positioned by the interlocking mechanism in a location so not as to be in contact with the developer container against the biasing force of the biasing member, and when the opening and closing cover is in the closed state, the detection member is positioned so as to be in contact with the developer container by the biasing force of the biasing member. According to the arrangement, the detection member and the developer container are in contact with each other with a very stable contacting force, thus making it possible to perform highly reliable detection of the presence and absence of developer or remaining developer.

14 Claims, 12 Drawing Sheets

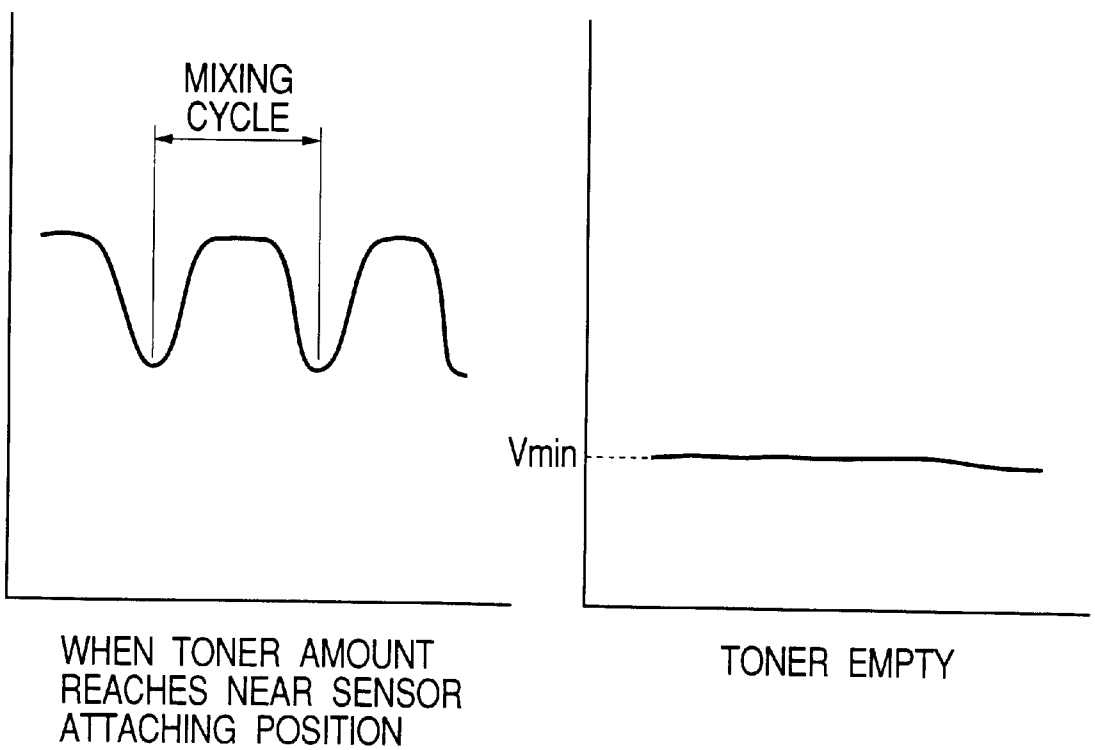
FIG. 6A
FIG. 6B
FIG. 6C
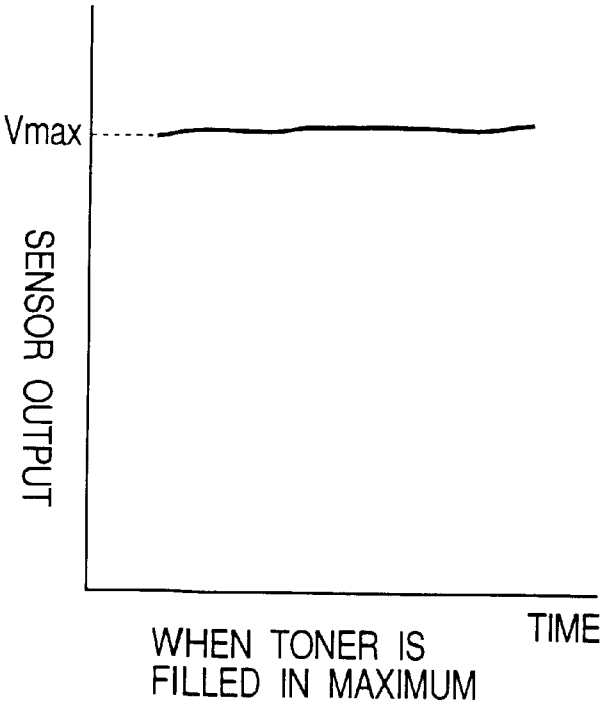

DEVELOPER DETECTION APPARATUS AND AN IMAGE FORMING APPARATUS

BACKGROUND OF THE INVENTION

1. Field of the Invention

The present invention relates to an image forming apparatus, such as an electrophotographic apparatus and an electrostatic recording apparatus. The invention also relates to a developer detection apparatus to detect the presence and absence or the remaining developer used for such image forming apparatus.

2. Related Background Art

Conventionally, the image forming apparatuses used for an electrophotographic apparatus have been often provided with a developer detection apparatus for detecting the amount of the remaining developer including the presence and absence of the developer.

As the method for detecting the amount of the remaining developer adopted for a developer detection apparatus of the kind, there are an optical method using the light emitting device and photodetecting device together; an electrostatic capacitance method whereby to detect the electrostatic capacitance of the developer; a piezoelectric method whereby to detect the pressure exerted by the developer by means of vibration; and some other various methods which have been proposed and put into practice.

Also, conventionally, there has been put in practice a cartridge method whereby to form at least an image bearing body and a developing device integrally to make them detachably mountable on the main body of an image forming apparatus. In this case, when the developer is completely consumed, the cartridges are replaced.

In this cartridge method, it is preferable to install or provide a detection sensor on the main body of the apparatus for the detection of the amount the remaining developer in the cartridge so that the detection sensor can be used repeatedly. In order to implement this method, it is generally and widely practiced to adopt a magnetic permeability sensor (toner sensor) as a detection means for detecting the magnetic permeability of the developer contained in a developer container from its outer side by the utilization of the magnetism of the developer in order to detect it by means of the voltage changes thereof.

The toner detection means for detecting the amount of the remaining developer using such toner sensor is shown in FIG. 14 as disclosed in Japanese Patent Application Laid-Open No. 3-264974. This means is aimed at repeatedly using the expensive toner sensor separately from the developing device which is made replaceable as an expendable component. Then, this means comprises a shaft 106 that rotates clockwise or counterclockwise while being interlocked with the opening or closing of the upper structure 107 which forms the cover of the developing device; an elastic member 105 fixed to one end of this shaft 106; and the toner sensor 120 fixed to the swingable holder 101 to detect the amount of the remaining toner. Then, interlocked with the closing of the upper structure 107, the shaft 106 rotates to swing the holder 101 by the biasing force exerted by the elastic member 105. The toner sensor 120 is allowed to be in contact with the toner detection point of the developing device in order to detect the amount of the remaining toner. Also, interlocked with the opening operation of the upper structure 107, the shaft 106 rotates to release the biasing force exerted by the elastic member 105. Thus, the holder 101 and the toner sensor 120 are allowed to part form the toner detecting point.

When the magnetic permeability sensor (toner sensor) is used to detect the magnetic permeability of the developer from the outer side of the developer container with the changes of voltage by the utilization of the magnetism of the developer, the close contact between the developer container and the detection surface of the sensor is extremely important. Particularly, the extremely fine changes in the gap between the magnetic permeability sensor and the developer container may result in a greater output fluctuation. There is a need for obtaining a closer contactness between them.

In this respect, if there are errors in the installation of the sensor, the looseness along with the attaching and detaching of the developer container, the variation of biasing force exerted on the sensor with respect to the developer container, or the like, the contact between the sensor and the developer container tends to be lower. Then, the resultant accuracy of detection is lowered eventually.

In the method, such as disclosed in Japanese Patent Application Laid-open No. 3-264974, in which interlocked with the closing operation of the upper structure, the shaft rotates to swing the holder by biasing force exerted by the elastic member, and the toner sensor is placed to be in contact with the toner detection point in the developer container, there are some cases where the appropriate positional relationship is not obtainable between the developer container, the sensor, and the elastic member due to the accumulated variations of the dimensional precision and errors in installation of each of the plural members, such as the upper structure, shaft, holder, and elastic member.

In such a case, the amount of deformation of the elastic member varies greatly when the cover is closed. Along with such variation, the basing force of the sensor is caused to vary greatly, hence making it difficult to obtain the appropriate contacting force that should be exerted by the sensor.

If the contacting force of the sensor is weak, it becomes impossible to obtain close contact between the developer container and the detection surface of the sensor. On the contrary, if the contacting force becomes too strong, the developer container, the holder, and the toner sensor itself tend to be distorted. As a result, the close contact can hardly be obtained, hence making it impossible to secure the exact sensor output.

Also, there is a drawback that may hinder obtaining close contact between the contact surface of the developer container and the detection surface of the sensor themselves if the angular deviation takes place between them, because the detection surface of the sensor may be biased in abutting upon the developer container.

SUMMARY OF THE INVENTION

It is an object of the invention to provide a developer detection apparatus and an image forming apparatus capable of performing a highly reliable developer detection.

Also, it is another object of the invention to provide a developer detection apparatus capable of performing a highly reliable detection of the presence and absence of developer or the amount of the remaining developer, with an extremely stable contact between the developer container and the detection member, and also, to provide an image forming apparatus provided with such a developer detection apparatus.

Also, it is still another object of the invention to improve the durability of a detection member and provide a developer detection apparatus which can be manufactured at lower cost, and also, to provide an image forming apparatus having such developer detection apparatus arranged therefor.

Also, it is a further object of the invention to provide a developer detection apparatus which comprises a detection member to detect the developer in the developer container detachably mountable on the main body of an image forming apparatus; a biasing member to bias the detection member to the developer container side; and interlocking means to be interlocked with the opening and closing of the cover used for attaching or detaching the developer container to and from the main body of the apparatus. This developer detection apparatus is positioned in a location not to abut on or to be in contact with the developer container against the biasing force exerted by the biasing member by use of the interlocking member when the opening and closing cover is open, and the detection member abuts upon the developer container by the biasing force of the biasing member when the cover is closed.

Other objectives and advantages besides those discussed above will be apparent from the description of following detailed description and the appended claims with reference to accompanying drawings.

BRIEF DESCRIPTION OF THE DRAWINGS

FIGS. 6A, 6B and 6C are views which illustrate the waveforms of the analogue detection signal of the magnetic bridge sensor.

DETAILED DESCRIPTION OF THE PREFERRED EMBODIMENTS

Hereinafter, with reference to the accompanying drawings, the description will be made of a developer detection apparatus and an image forming apparatus further in detail in accordance with the present invention.

(First Embodiment)

Now, with reference to the accompanying drawings, a specific description will be made of an example in which the invention is applicable to a facsimile apparatus as a first embodiment thereof. Here, the description will be made in the following order:

(1) The entire structure of a facsimile apparatus.

(2) The reading device to read information.

(3) The structure of an image forming apparatus to record the received information.

(4) The structure of each portion of a process cartridge used for the image forming apparatus.

(5) The description of a magnetic bridge sensor serving as a developer detection member.

(6) The structure of the developer detection member installed to oppose to the outer circumferential surface of the wall of the toner chamber near its bottom.

(7) Holding means and contact (abutting) means of the magnetic bridge sensor.

(The Entire Structure of the Facsimile Apparatus)

Figure 1:
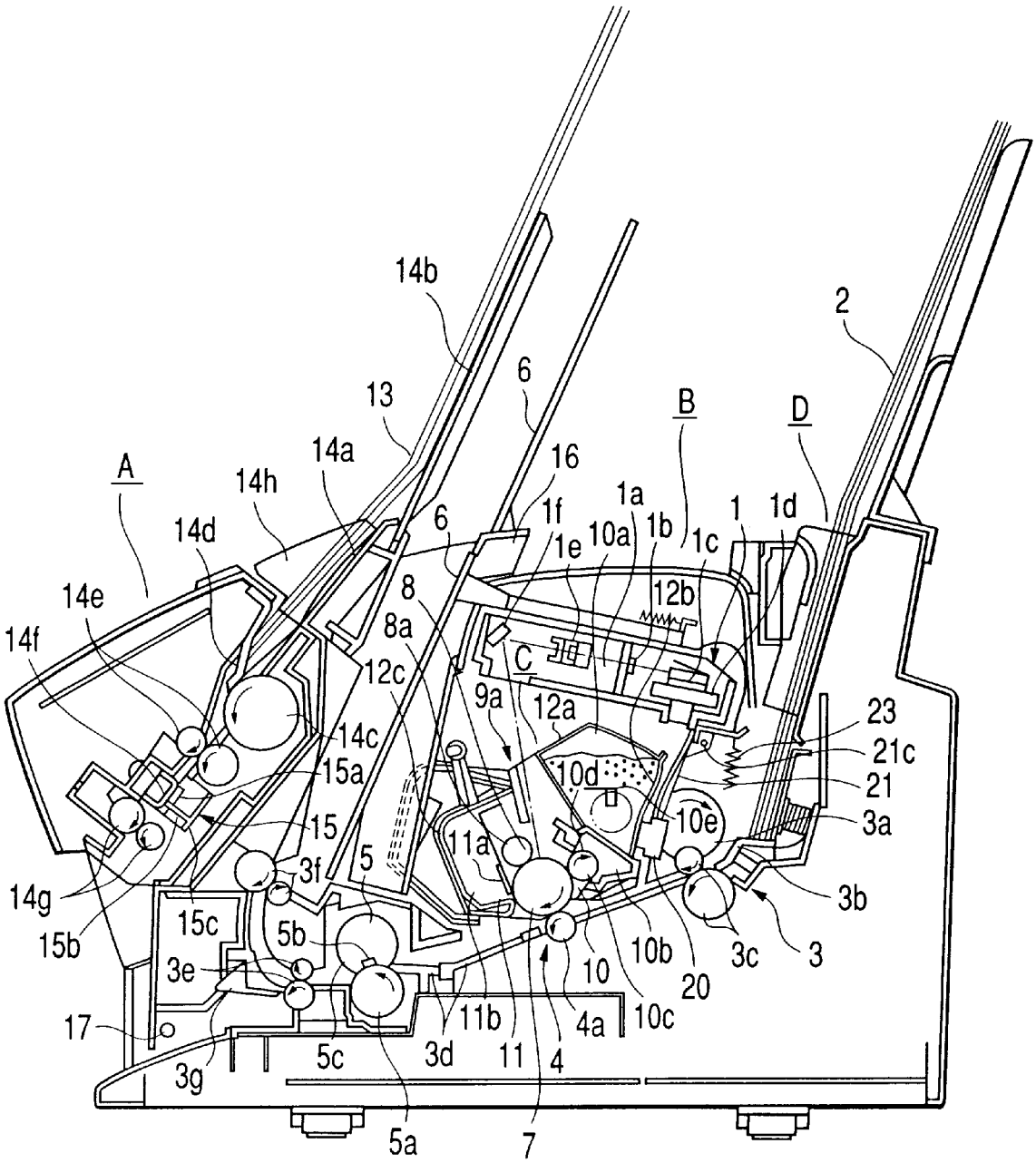
FIG. 1 is a cross-sectional view which shows the structure of a facsimile apparatus in accordance with the embodiment of the present invention.
Figure 2:
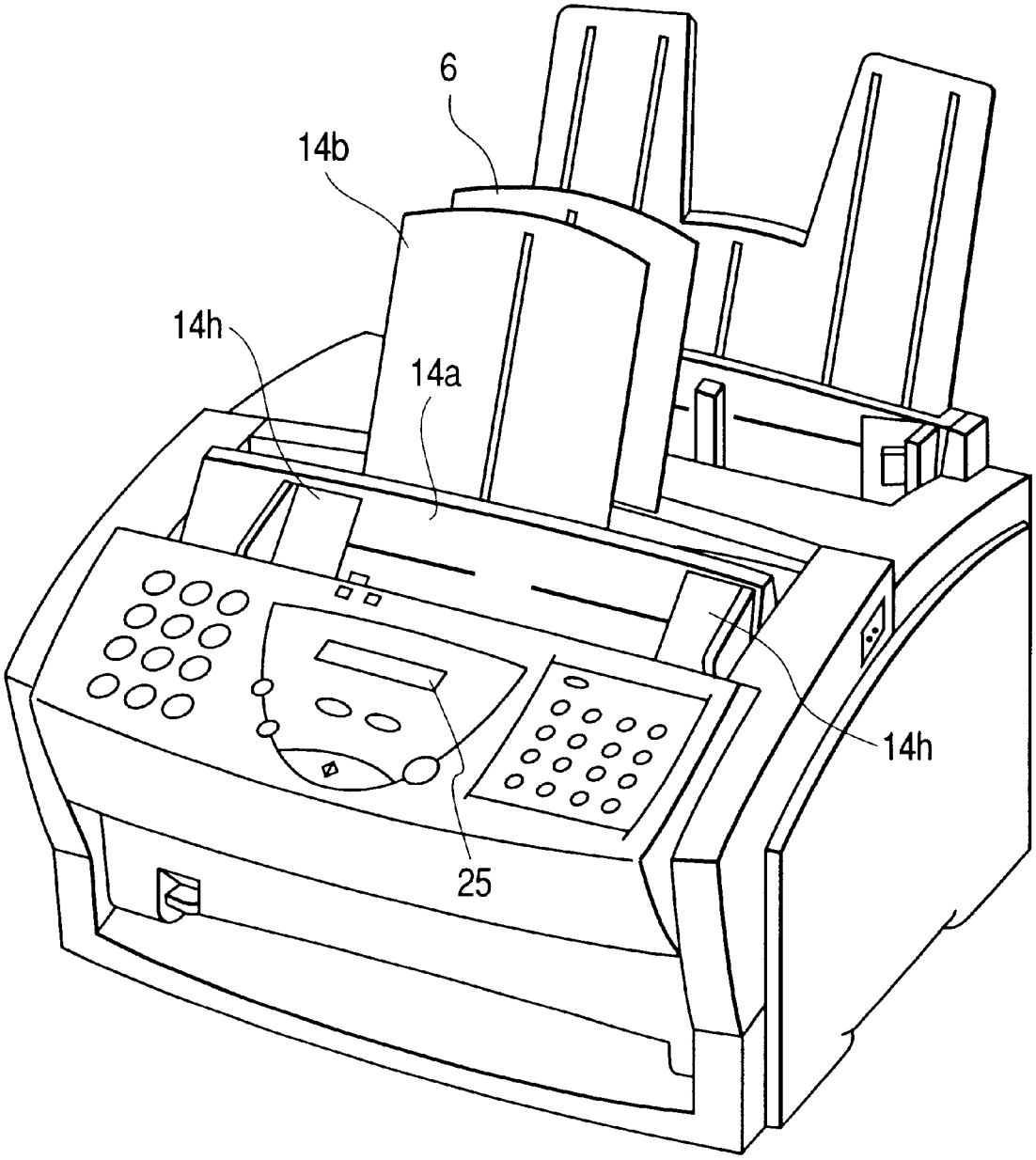
FIG. 2 is a perspective view which shows the outer appearance of the facsimile apparatus represented in FIG. 1.

FIG. 1 is a constructional explanatory view which illustrates a facsimile apparatus provided with an image forming apparatus having a process cartridge mounted on it in accordance with the present invention. FIG. 2 is a perspective view which shows the outer appearance thereof.

As shown in FIG. 1, the facsimile apparatus has an original reading device A arranged on the upper left side of FIG. 1, and an image forming apparatus B on the right-hand side thereof. The information read by use of the original reading device A is transmitted to facsimile equipment installed on some other apparatus in the facsimile mode. The information thus read is recorded by its own image forming apparatus B in the copy mode.

As shown in FIG. 1, the image forming apparatus B forms the toner image on the photosensitive drum 7 serving as an image bearing body through the optical system 1 by irradiating the optical image on the basis of the image information. Then, in synchronism with the formation of the toner image, the recording sheet 2 is conveyed by use of conveying means 3, and the toner image formed on the photosensitive drum 7 in the image formation portion, which is arranged in the form of a cartridge that serves as the process cartridge C, is transferred to the recording sheet 2 by use of transfer means 4. The recording sheet 2 is then conveyed to fixation means 5 to fix the transferred toner image, and the toner image thus fixed is exhausted to the tray 6 or outside the apparatus.

Also, there is provided on the main body side a magnetic bridge sensor 20 which abuts upon the developing wall member 12*b* of the process cartridge C in order to detect the presence and absence of toner in the toner chamber 10*a*.

(The Original Reading Device)

The original reading device A conveys an original 13 and reads the information on the original. As shown in FIG. 1, the original reading device is structured so as to separate the originals 13 stacked on the original stacker 14*a* and the auxiliary stacker 14*b* one by one by means of the separation roller 14*c* and the separation piece 14*d* which abuts upon the roller under pressure, and to convey the original 13 thus separated by use of a pair of feed rollers 14*e*. The information on the original 13 is read with the close contact sensor of the reading means 15 by pressing the original 13 to the sensor by use of pressure means 14*f*. After that, the original 13 is exhausted by use of a pair of the exhaust rollers 14*g* outside the original reading device A.

The reading means 15 reads information by irradiating light from LED 15*a*, which serves as the light source, onto the surface of the original 13, and focuses the reflection light therefrom on the electro-optical conversion device 15*c* through the short range focal lens 15*b* for reading. The signals thus generated are transmitted to some other equipment in the facsimile mode or transmitted to its own image forming apparatus B in the copy mode through the control means which will be described later.

In this respect, there is provided on the original stacker 14*a,* a slider 14*h* which is slidable in the direction (in the width direction of the original 13) at right angles to the conveying direction of the original 13. By setting the slider 14*h* slidably to be in agreement with the width of the original 13, it is possible to true up both sides of the originals 13 stacked on the original stacker 14*a*.

(The Image Forming Apparatus)

Now, in the following order, the description will be made of the structure of each portion that constitutes the image forming apparatus B to form images in accordance with recording signals:

(1) The optical system.

(2) Recording sheet conveying means.

(3) Transfer means.

(4) Fixation means.

(5) Process cartridge installation means.

(The Optical System)

The optical system 1 is arranged to irradiate optical images to the photosensitive drum 7 with light irradiation in accordance with image information read out from an external device or the like. As shown in FIG. 1, a laser diode 1*b,* a polygon mirror 1*c,* a scanner motor 1*d,* a focus lens 1*e,* and a reflection mirror 1*f* are housed in the optical unit 1*a*.

Then, for example, if image signals are received from a facsimile equipment installed on some other apparatus, the laser diode 1*b* emits light in accordance with image signals and irradiates it onto the polygon mirror 1*c* as image light. The polygon mirror 1*c* rotates at high speed by means of the scanner motor 1*d* and irradiates the image light reflected upon the polygon mirror 1*c* to the rotating photosensitive drum 7 through the focus lens 1*e* and reflection mirror 1*f*. In this manner, the surface of the photosensitive drum 7 is selectively exposed to form the latent images corresponding to the image information.

(Recording Sheet Conveying Means)

The conveying means 3 for conveying a recording sheet 2 is arranged on the right-hand side of the image forming apparatus B in FIG. 1, and the upper-most one of the recording sheets 2 stacked on the sheet feed portion D is separated from them one-by-one by means of a pick up roller 3*a* arranged on the left side of the leading end of the recording sheets 2 thus stacked in cooperation with the separation pad 3*b* which is in contact with the pick up roller 3*a* under pressure. The recording sheet thus separated is conveyed to a pair of conveying rollers 3*c*. In synchronism with the operation of the image formation, the pair of the carrying roller 3*c* convey the recording sheet 2 to the image transfer unit. Then, the recording sheet 2 after the image has been transferred on it is conveyed to fixation means 5 by use of the guide member 3*d*. The recording sheet 2 after fixation is carried over to the tray 6 by means of the pairs of exhaust rollers 3*e* and 3*f* if it is required to exhaust the sheet with its face down or the sheet is exhausted by the pair of exhaust rollers 3*e* outside the apparatus by changing the switch over guide 3*g* if it is required to exhaust the sheet with its face up.

(Transfer Means)

Transfer means 4 is for transferring the toner image, which has been formed on the photosensitive drum 7 in the image forming portion, to the recording sheet 2. In accordance with the present embodiment, the transfer means 4 shown in FIG. 1 is formed by a transfer roller 4*a*. In other words, the recording sheet 2 is pressed by use of the transfer roller 4*a* to the photosensitive drum 7 of the installed process cartridge C in order to transfer toner on the photosensitive drum 7 to the recording sheet 2 by the application of voltage to the transfer roller 4*a* with the reversed polarity of the toner image formed on the photosensitive drum 7.

(Fixation Means)

Fixation means 5 is for fixing the toner image transferred to the recording sheet 2 by means of the voltage application to the transfer roller 4. As shown in FIG. 1, the structure thereof is formed by a driving roller 5*a* which is driven to rotate, and a fixation member 5*c* provided with a sheet member which rotates following the driving roller 5*a* with which it is in contact under pressure. In other words, when the recording sheet 2 having the toner image transferred onto it in the image formation unit passes between the driving roller 5*a* and the fixation member 5*c,* pressure is applied to it by them, and also, heat is applied to it by means of a heater 5*b* to fix toner on the recording sheet 2.

(Process Cartridge Installation Means)

Process cartridge installation means is provided for the interior of the image forming apparatus B in order to install the process cartridge C. The process cartridge C is attached to or detached from the main body of the apparatus by opening the opening and closing cover 16. In other words, as shown in FIG. 1, there is provided a supporting shaft 17 on the lower left side of the main body of the apparatus, which serves as the rotation center of the opening and closing cover 16. Then, the structure is arranged so as to enable the opening and closing cover 16 to be rotative centering on the supporting shaft 17. With the opening and closing cover 16 being open, there is a space in the main body of the apparatus to install the cartridge, and guide grooves (not shown) are arranged on the wall faces on both side of the space, respectively. Then, the process cartridge C is inserted while guiding the drum shafts which support the photosensitive drum 7 along the guide grooves. The structure is arranged to install the process cartridge C on the image forming apparatus B when closing the opening and closing cover 16 in this manner.

(Process Cartridge)

Now, the description will be made of each structure of the process cartridge C which is installed on the image forming apparatus B to constitute the image forming portion described above.

Figure 3:
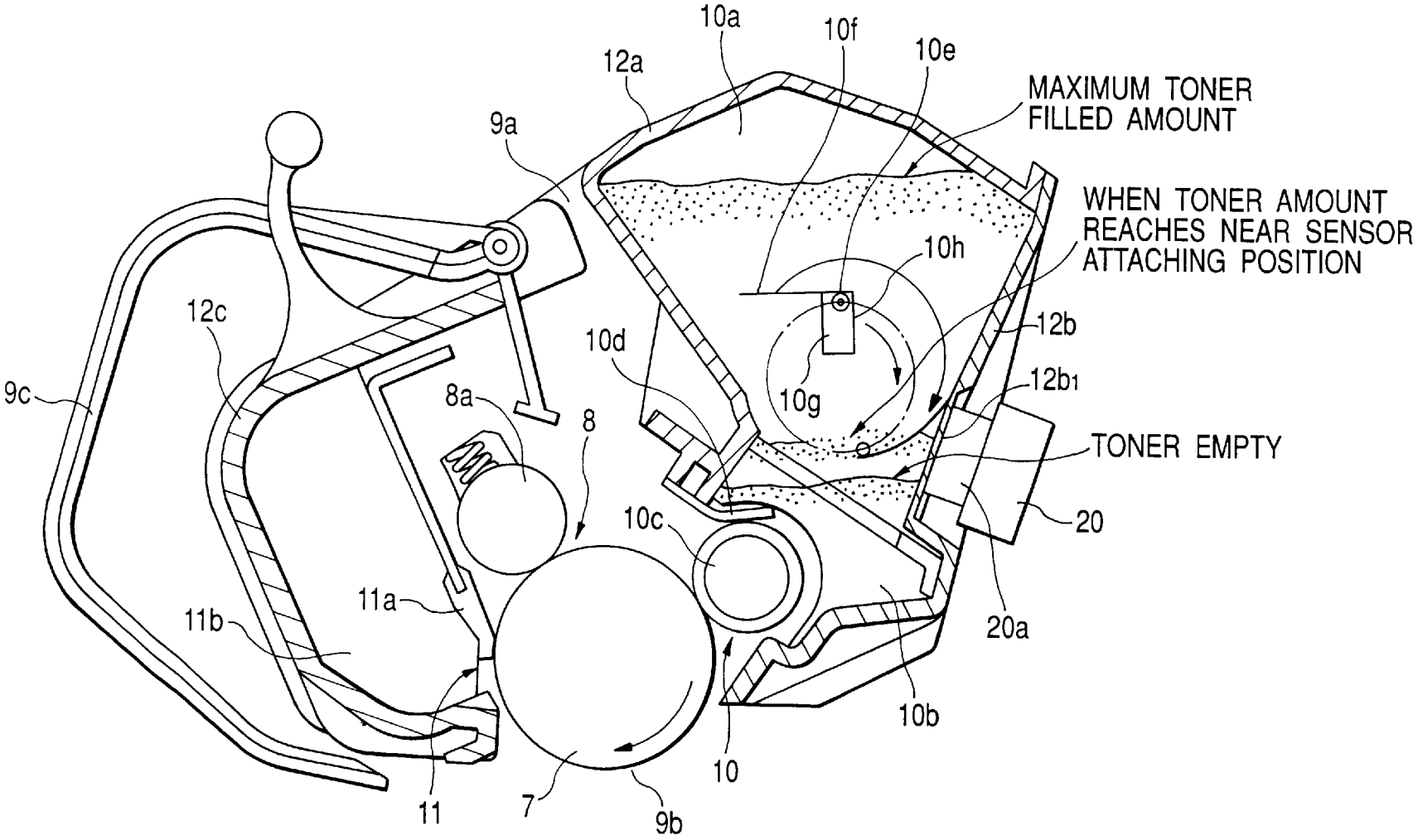
FIG. 3 is a constructional cross-sectional view which shows a magnetic bridge sensor and a process cartridge.

As shown in FIG. 1 to FIG. 3, the process cartridge C is structured so that the photosensitive dram 7, which is provided with the photosensitive layer serving as the image bearing body, is arranged to rotate in the direction indicated by the corresponding arrows in FIG. 1 and FIG. 3. The surface thereof is electrostatically charged uniformly when voltage is applied to the charging roller 8*a* serving as electrostatic charging means 8. Then, the latent image is formed by the optical image carried from the optical system 1, which is exposed on the photosensitive drum 7 through the exposure aperture 9*a*. Subsequently, the image is developed by developing means 10.

Here, the process cartridge should be good enough if only it comprises at least an image bearing body and developing means integrally formed together.

The developing means 10 supplies to the development chamber 10*b* the magnetic toner which is the magnetic developer contained in the toner chamber 10*a* serving as the developer container. Then, at the same time that the developing roller 10*c* installed in the development chamber 10*b* is rotated, the toner layer, which is given the charge tby the friction charging by use of the development blade 10*d,* is formed on the developing roller 10*c* having a fixed magnet in it. Hence, the toner is transferred to the photosensitive drum 7 in accordance with the latent image in order to form the toner image, and then, the visible image is produced. In this case, the agitation bar 10*a* installed in the toner chamber 10*a,* which is connected with the developing roller 10*c* by means of gears (not shown), is allowed to rotate in the direction indicated by an arrow shown in FIG. 3 to agitate toner. The toner is smoothly supplied from the toner chamber 10*a* to the development chamber 10*b* without stagnation.

Then, the structure is further arranged so that the voltage having the reversed polarity to the toner image is applied to the transfer roller 4*a* in order to transfer the toner image to the recording sheet 2, and after that, cleaning means 11 provided with the cleaning blade 11*a* is used to scrape off the toner remaining on the photosensitive drum 7 and collect it into the waste toner reservoir 11*b*. In this way, the remaining toner on the photosensitive drum 7 is removed.

Each of the parts, such as the photosensitive drum 7, is housed in the form of a cartridge in the process cartridge C structured by connecting the toner development frame member 12*a,* the development wall member 12*b,* and the cleaning frame member 12*c*. In other words, the toner development frame member 12*a* and the development wall member 12*b* are welded to form the toner chamber 10*a* and the development chamber 10*b* as well. Then, the developing roller 10*c* and the development blade 10*a* are installed in the development chamber 10*b*. Also, to the cleaning frame member 12*c,* the respective parts are fixed to constitute the photosensitive drum 7, the charging roller 8*a,* and the cleaning means 11. In this way, the toner development member 12*a* and the cleaning frame member 12*c* are connected to form the process cartridge C.

For the process cartridge C, there are provided the exposure aperture 9*a* to expose the image, and the transfer aperture 9*b* for enabling the photosensitive drum 7 to oppose to the recording sheet 2. Further, a shutter member 9*c* is fixed, which can open or close both apertures 9*a* and 9*b*.

Also, on the portion of the development wall member 12*b* with which the magnetic bridge sensor 20 as detection means for detecting the presence and absence of toner in the toner chamber 10*a* are in contact, a recessed portion 12*b*1 whose thickness is partly biased for abutting of sensor is arranged on the outer side of the toner chamber 10*a* in order to enhance the detection accuracy with the magnetic bridge sensor 20 being placed more closely to the toner. With the structure thus arranged, it is made possible to prevent any deviation from taking place in detecting the reduced amount of toner as it is consumed for more reliable detection of the presence and absence of the toner.

Further, the scraping sheet 10*f* fixed to the agitation bar 10*e* rubs the toner presence and absence detection portion to prevent toner from being stagnated on that portion when the amount of toner is reduced as it is consumed. The scraped off toner is assuredly supplied to the development chamber 10*b*. The scraping sheet 10*f* is fixed in the tangential direction of the rotational circle of the agitation bar 10*e,* and also, it is made deformational when the scraping sheet 10*f* performs the scraping operation with respect to the inner wall of the toner chamber 10*a,* hence giving very weak pressure onto the scraping sheet, which is just good enough to scrape off the toner when the toner is stagnated on the toner presence and absence detection portion. This is taken so as not to allow the quality of toner to vary due to the pressure exerted on the toner. Therefore, the thickness of the scraping sheet 10*f* is approximately 50 $\mu$m. Further, a large through hole is arranged on the central portion of the scraping sheet 10*f* to make its stiffness as soft as possible in order to avoid exerting any excessive pressure on the toner.

Figure 4A:
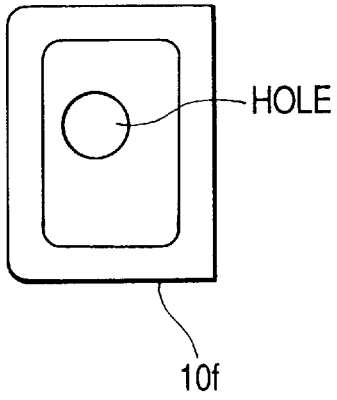
FIGS. 4A, 4B and 4C are explanatory views which illustrate an agitation bar and a scraping sheet.
Figure 4B:
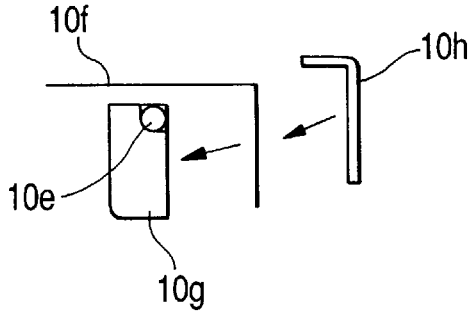
Figure 4C:
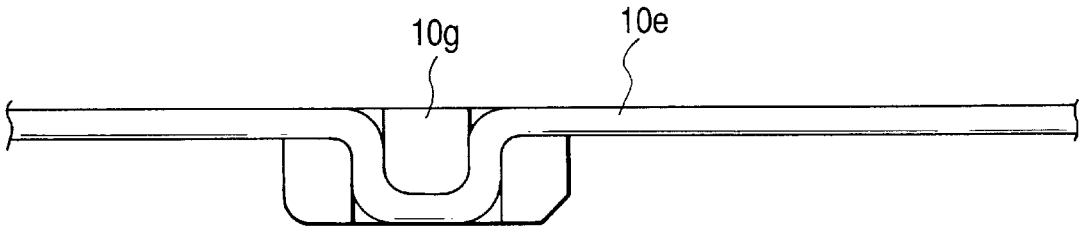

As shown in FIGS. 4A to 4C, the scraping sheet 10*f* is structured on the bent portion of a part of the agitation bar 10*e* by being sandwiched between an installation stand 10*g* and a pressure plate 10*h*. Since a sheet whose thickness is as thin as 50 $\mu$m is used as the scraping sheet 10*f,* there is a possibility that the sheet is deformed when it is handled. Particularly, when the sheet is installed in the tangential direction of the rotational circle of the agitation bar 10*e,* it is largely dependent on the accuracy of the bent portion and its deformation. Therefore, the structure is arranged to provide a portion which is bent at right angles for the pressure plate 10*h* and sandwich the sheet with the installation stand 10*g*. In this manner, it is made possible to correct the installation of the sheet so that it is accurately in the tangential direction of the rotational circle of the agitation bar 10*e*.

(The Magnetic Bridge Sensor)

Figure 5:
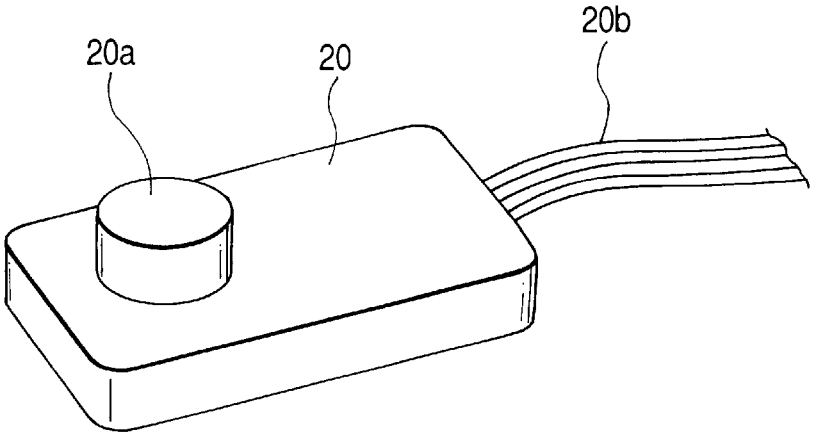
FIG. 5 is a perspective view which shows the outer appearance of a magnetic bridge sensor.

The magnetic bridge sensor (magmatic permeability sensor) 20 is formed integrally with a column type detection head 20*a* mounted on its main body as shown in FIG. 5. Then, through the signal lines 20*b* for input and output use, this sensor exchanges the detection signals with the main body of the facsimile apparatus.

Figure 13:
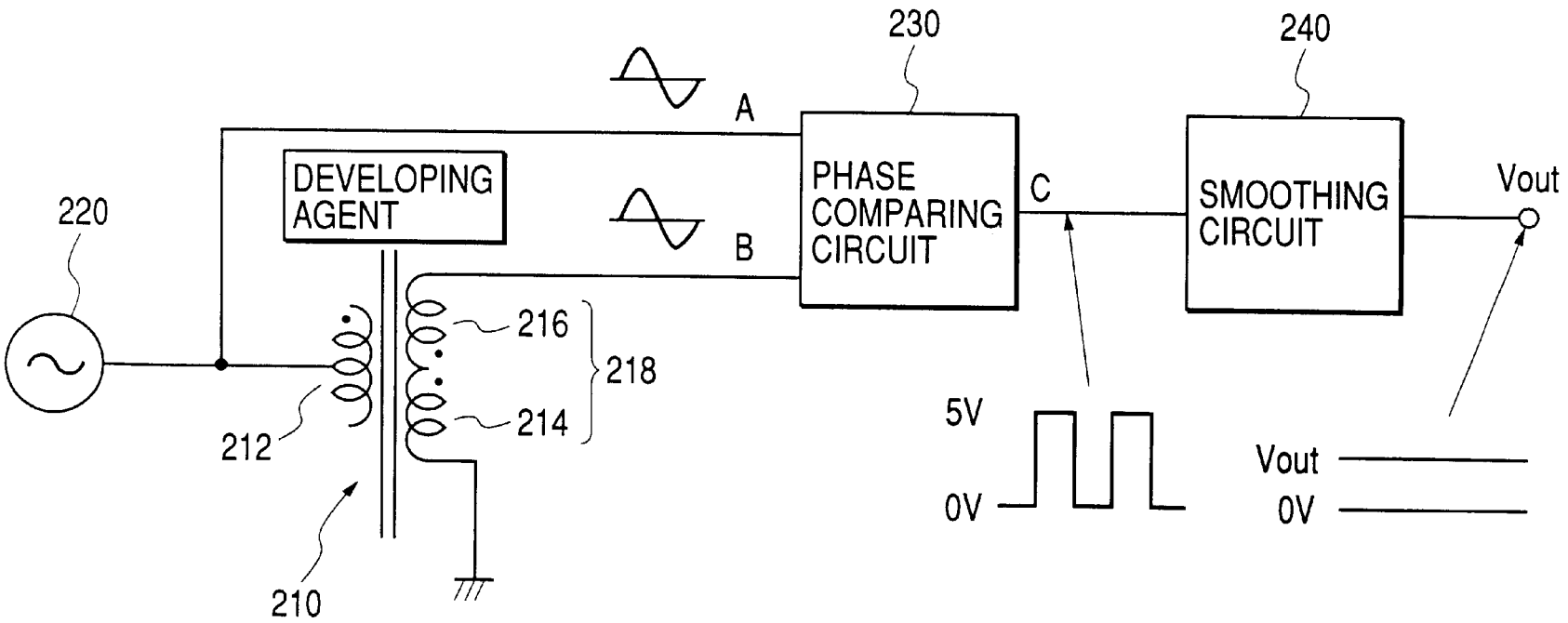
FIG. 13 is a block diagram which shows the principle of the toner sensor of magnetic bridge type.
Figure 14:
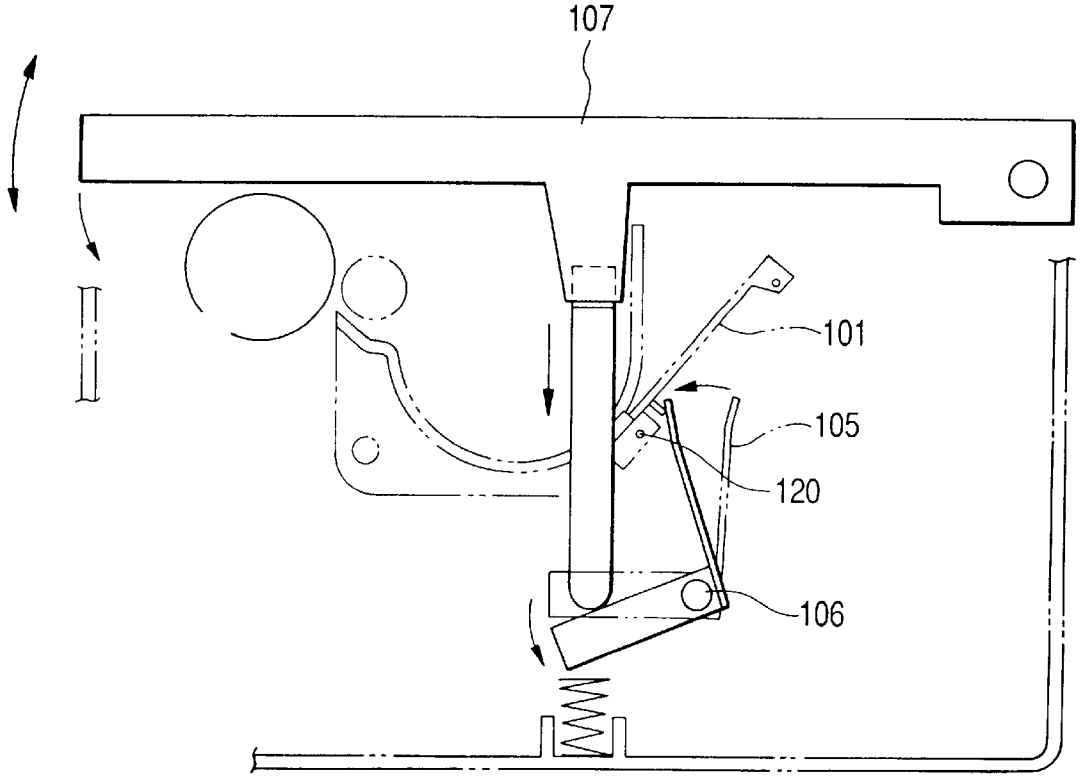
FIG. 14 PRIOR ART
FIG. 14 is a structural view which schematically shows one example of the conventional toner sensor.

In the interior of the detection head 20*a,* a detection transformer 210 is buried as shown in FIG. 13. The detection transformer 210 has one primary coil 212 and two secondary coils 218 having the standard coil 214 and the detection coil 216. The detection coil 216 is positioned on the ceiling face side of the detection head 20*a*. The standard coil 214 is positioned on the reverse side of the detection head 20*a* with the primary coil 212 between them.

When the current having the signal of constant waveforms is inputted from the oscillator 220 installed in the main body of the sensor into the primary coil 212, the current having signal of certain waveforms is also caused by the electromagnetic induction to run through the two secondary coils 218 having the standard coil 214 and the detection coil 216. The signal A having the constant waveforms from the oscillator 220 at that time, and signal B of certain waveforms of the current running from the detection coil 216 are discriminated by use of the phase comparison circuit 230 arranged in the main body of the sensor to output the signal C. Then, by the signal Vout output through the smoothing circuit 40, the detection is made to examine the concentration degree of the magnetic substances on the ceiling face side of the detection head 20*a*. In other words, a different output is obtainable depending on the case where the magnetic substances are present in front of the detection head 20*a* or where there is none of them.

Also, in order to deal with the difference of magnetic concentration or the like of the magnetic substances to be detected by the sensor, there is provided the ferritic screw core on the central portion of the detection transformer in the shifting direction, and, with the adjustment of position of this screw core, it becomes possible to effectuate detection correctly.

(The Method for Detecting the Presence and Absence of Developer)

The method for detecting the presence and absence of developer is to detect the presence and absence of toner contained in the toner chamber 10*a* by the magnetic bridge sensor 20. As shown in FIG. 1 and FIG. 3, the structure is arranged in such a manner that in the main body of the apparatus, the magnetic bridge sensor 20 is installed to enable the detection head 20*a* to face or oppose the development wall member 12*b*1 near the bottom of the toner chamber 10*a,* and that the detection head 20*a* is mounted in condition so as to detect the absence of toner in a position where toner becomes almost empty.

FIGS. 6A to 6C show the relationship between the amount of the remaining toner and the analogue detection signals of the magnetic bridge sensor 20. During some time from when toner is filled in maximum (the amount of the remaining toner have indicated "full"), the voltage shows its highest output (Vmax) regardless of passing of time (FIG. 6A). When the amount of the remaining toner reside near the location where the magnetic bridge sensor 20 is installed or attached, the output voltage is affected by the scraping sheet 10*f* to cause the output to fluctuate by the agitation cycle of the agitation bar 10*e,* and the value of voltage output is gradually lowered, while generating ripples on the negative side (FIG. 6B). When the amout of the remaining toner are made empty (at the time of Empty), the output voltage becomes stable and the lowest output voltage (Vmin) is indicated (FIG. 6C). Therefore, it is possible to obtain the output corresponding to the amount of the remaining toner immediately before the toner becomes absent. The presence and absence of toner is thus determined by the outputs obtainable from the sensor.

Figure 7:
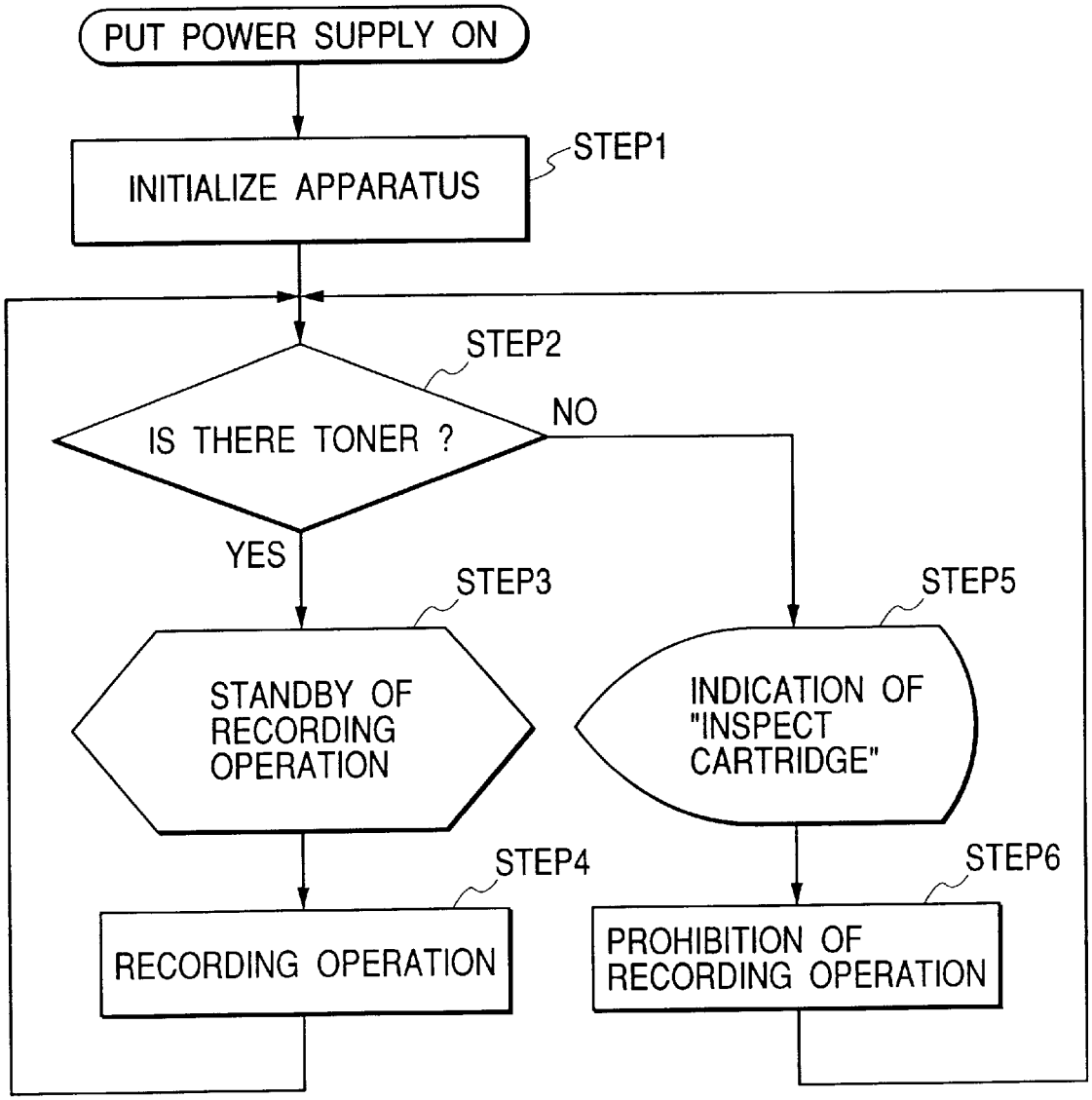
FIG. 7 is a flowchart which shows the process of determination as to the presence and absence of toner.

FIG. 7 is a flowchart which shows the flow of the determination to be made with respect to the presence and absence of toner. At first, the initialization of the apparatus is made (step 1). Then, the determination of toner presence or absence is carried out as described above (step 2). If affirmative (the toner is present), the standby process is taken as to the recording operation (step 3). Subsequently, the process enters the recording operation (step 4). On the other hand, if negative, the indication "check cartridge" is displayed on the operation panel (step 5). Then, it is prohibited to operate recording (step 6).

Figure 8:
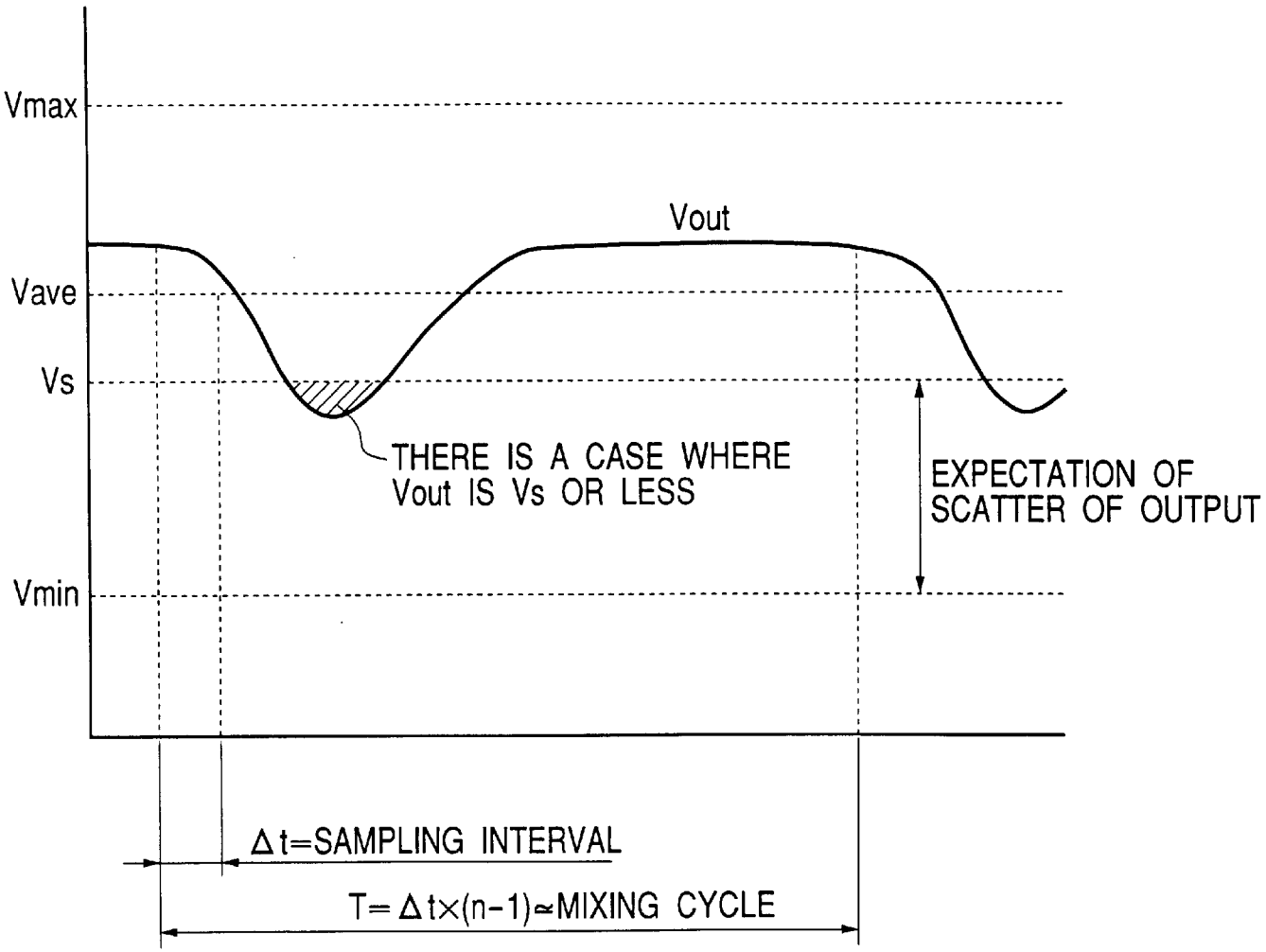
FIG. 8 is a explanatory view which illustrates the method of toner absence determination.

Now, in conjunction with FIG. 8, the description will be made of the method for determining the absence of toner.

Due to the output fluctuation of the magnetic bridge sensor itself; the voltage fluctuation of the supply-source on the main body side; the fluctuation of toner magnetism itself; or the like, the sensor output (Vout) tends to vary when the toner is absent. Therefore, it is necessary to set the value of the sensor output (slice level=Vs) with an estimate of such fluctuations when the toner absence should be determined.

However, when the amount of the remaining toner reside near the location where the magnetic bridge sensor 20 is installed, the value of the output voltage is gradually lowered, while causing the output fluctuations per rotational cycle of the agitation bar 10*e* due to the influence of the scraping sheet 10*f*. Therefore, if the toner absence is simply determined in accordance with the timing output which has become Vs or less, it is impossible to determine the toner absence correctly, because the toner absence is indicated in spite of the fact that there is still remaining toner up to near the location where the magnetic bridge sensor is installed.

Here, therefore, in accordance with the present embodiment, the sensor output voltage is worked out as the mean value (Vave) of the constant cycle of calculation (T) (constant number of samples (n)), and it is arranged that the toner absence is determined only when the mean value Vave becomes smaller than the sensor output value Vs.

Further, in accordance with the present embodiment, the interval (Δt) at which the CPU in the main body samples the sensor output voltage is set at 0.6 sec. approximately. Also, the calculation cycle (T) in which the mean value (Vave) is worked out is in agreement approximately with the rotational cycle of the scraping sheet 10*f* (4.3 sec). The mean value is calculated with the sampling numbers n for 8 times, that is, T=0.6×(8−1)=approximately 4.2 sec. Here, the output caused to fluctuate due to the influence of the scraping sheet 10*f* is comparatively stable, and even when the output fluctuations take place, it is possible to make the determination of the toner absence correctly by making such determination only when the mean value Vave of the intervals of the cycle T becomes smaller than the value of the sensor output Vs.

In this way, the user is informed of the check requirement of the process cartridge C by indicating the toner absence information thus detected on the display of the operation panel 25 shown in FIG. 2. Thus, the user is informed and urged to exchange cartridges C, and at the same time, the recording operation is prohibited with respect to the facsimile process, hence making it possible to prevent the omission of the image information due to faint and patchy prints of the image to be recorded.

(Holding Means and Abutting Means of the Magnetic Bridge Sensor)

Now, the description will be made of holding means of the magnetic bridge sensor 20.

Figure 10:
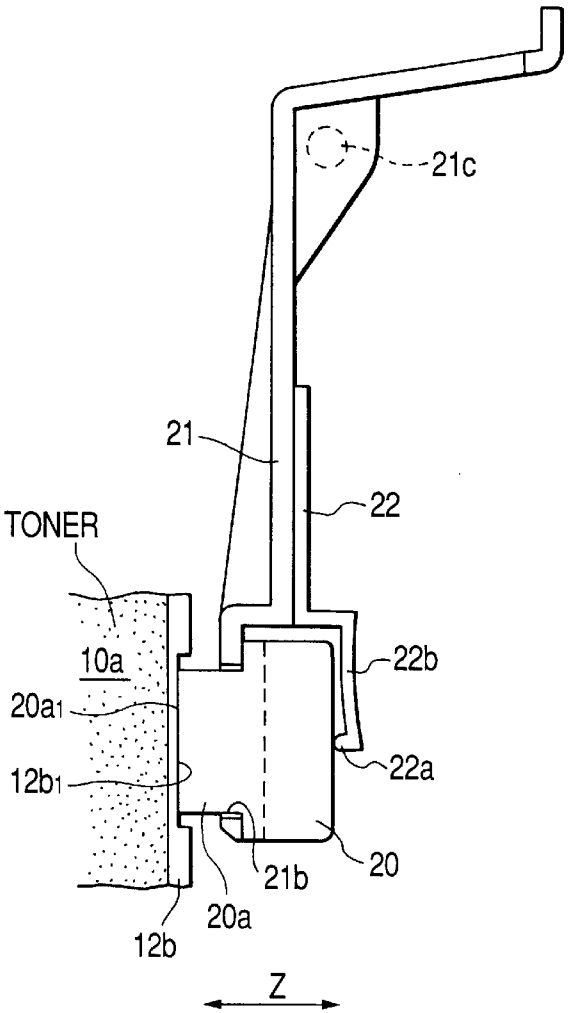
FIG. 10 is a side view which shows holding means of the magnetic bridge sensor.
Figure 9:
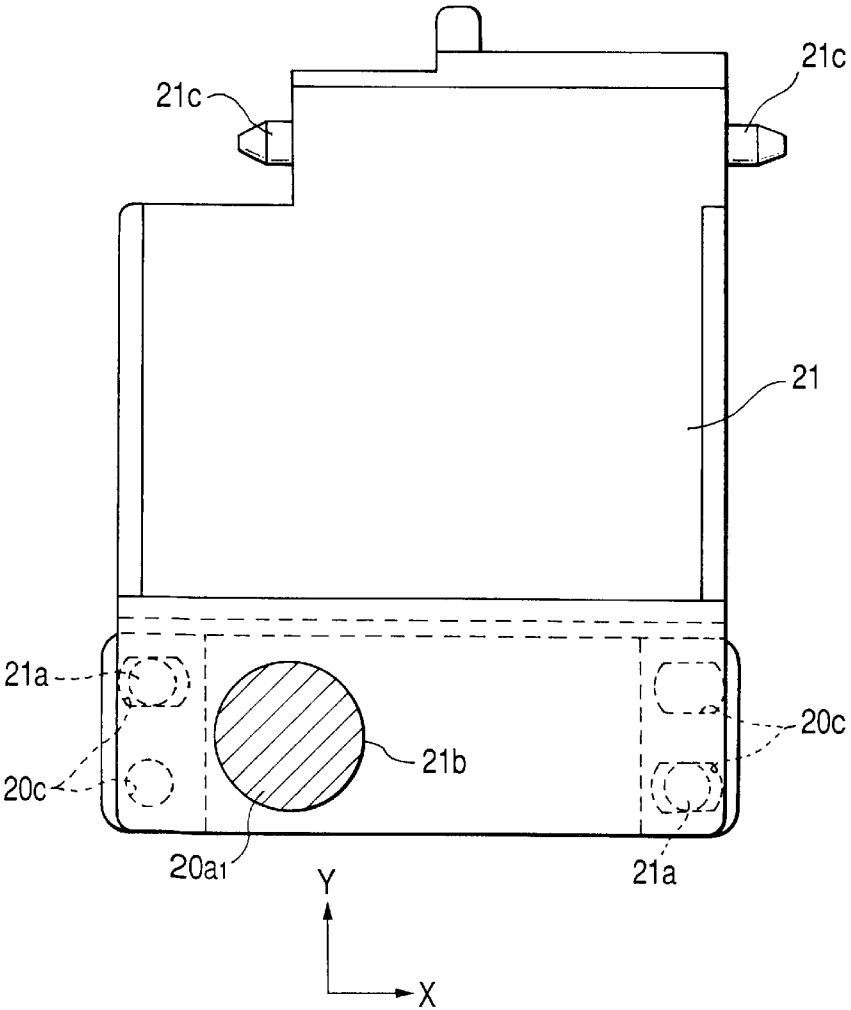
FIG. 9 is a front view which shows holding means of the magnetic bridge sensor.

As shown in FIG. 9 and FIG. 10, the structure is arranged to sandwich the magnetic bridge sensor 20 with the sensor holder 21 and the pressure member 22. Briefly, the sensor holder 21 is formed by a rectangular plate member which is bent in the form of a crank when observed on the section taken vertically. Also, the pressure member 22 is provided with a bent portion in the form of a crank. The vertical portion on a part thereof is joined to the lower vertical portion of the sensor holder 21 together by an appropriate means. It is then structured to sandwich the magnetic bridge sensor 20 with the lower parts of both of them.

In the direction Y in FIG. 9, that is, the top to bottom direction of the sensor holder 21, two positioning bosses 21*a,* each provided at different locations on the sensor holder 21 having different heights from each other, are inserted into the two corresponding positioning holes of the four positioning holes 20*c* arranged substantially in the vicinity of the four corners of the magnetic bridge sensor 20. In the direction X, that is, the left to right direction in FIG. 9, the detection head 20*a* of the magnetic bridge sensor 20 is positioned by being inserted into the detection head hole 21*b* arranged with almost the same diameter of the sensor holder 21.

Also, in the direction Z, that is the left to right direction in FIG. 10, the lower vertical portion of the pressure member 22 fixed to the sensor holder 21, which serves as the pressure plate spring unit 22*b,* is provided with a biasing force exerted by elastic force. Further, on the lower end of the pressure plate spring unit 22*b,* there is formed a convex portion 22*a* which is substantially horizontal in a position at which it is substantially in contact with the center point of the reverse side of the detection head 20*a*. Then, by the compression force of the pressure plate spring unit 22*b,* the magnetic bridge sensor 20 is pressed to the sensor holder 21 through the convex portion 22*a*. Thus, the positioning bosses 21*a* and the detection head 20*a* are prevented from falling off from the corresponding positioning holes 20*c,* and the detection head hole 21*b* as well.

If there is metal on the circumference of the magnetic bridge sensor 20, the sensor output is influenced. Although such influence is more conspicuous on the center line of the detection head 20*a* in particular, the sensor holder 21 and the pressure member 22 which includes the pressure plate spring unit 22*b* are produced by plastic resin, such as polyacetal, in order to avoid such influence that may be exerted on the sensor output.

As shown in FIG. 9, the sensor holder 21 is supported by the supporting shaft 21*c* that extends horizontally from both sides of the upper portion thereof. The sensor holder is made rotative with the supporting shaft 21*c* as its fulcrum. Then, by the biasing force exerted by the biasing spring whose one end is fixed to the upper end of the sensor holder 21, the sensor holder rotates clockwise centering on the supporting shaft 21*c* in FIG. 9. Thus, the structure is arranged to enable the detection surface 20*a*1 of the detection head 20*a* of the magnetic bridge sensor 20 to abut upon the recessed portion 12*b*1 of the development wall member 12*b*. In this manner, the detection surface 20*a*1 of the detection head 20*a* is in contact with the development wall member 12*b* appropriately by the stable force exerted only by the biasing force of the biasing spring 23.

Also, slight gaps (looseness) are provided between the positioning bosses 21*a,* and the positioning holes 20*c,* as well as between the detection head 20*a* and the detection head hole 21*b*. When the detection surface 20*a*1 of the detection head 20*a* of the magnetic bridge sensor 20 abuts upon the recessed portion 12*b*1 of the development wall member 12*b* by means of the biasing spring 23 through the sensor holder 21, the magnetic bridge sensor 20 is allowed to float slightly from the sensor holder 21. As a result, there is no bite that may be caused otherwise on the positioning portion to make it possible to effectuate an inclination smoothly. The pressure is allowed to act upon almost the center of the reverse side of the detection head 20*a,* hence uniformly on the detection surface 20*a*1 . In this way, the detection surface 20*a*1 is equalized with respect to the recessed portion 12*b*1 of the development wall member 12*b* to be closely in contact with it to prevent the surface from being inclined or floating therefrom.

In order to obtain close contact between the detection surface 20*a,* and the development wall member 12*b,* while avoiding any distortion that may take place as to the developer container 10*a,* the sensor holder 21, or the magnetic bridge sensor 20 itself, it is desirable to exert a pressure of approximately 50 gf to 100 gf on the detection head 20*a*. With the present structure, the pressure is determined only by use of the biasing spring 23. Therefore, it is possible to effectuate the exertion of an extremely stable pressure. At the same time, even when an error occurs in the positional accuracy in the inclined condition of the sensor holder 21 and the development wall member 12*b,* there is no possibility that the sensor output is lowered due to the inclination or floating that may take place with respect to the detection surface 20*a*1 and the surface of the recessed portion 12*b*1 of the development wall member 12*b*. Here, the detection surface 20*a*1 of the detection head 20*a* and the development wall member 12*b* are equalized and closely in contact with each other. It is thus arranged to exert no influence on the value of the sensor output.

By the adoption of such structure as described above, the magnetic bridge sensor 20 is held so as to completely prevent the fluctuation of the sensor output from being caused by the looseness that may follow the installation of the sensor or the attachment and detachment of the cartridge. Thus, it is made possible to carry out a highly reliable detection of the presence and absence (or the amount of the remaining toners)

Figure 11:
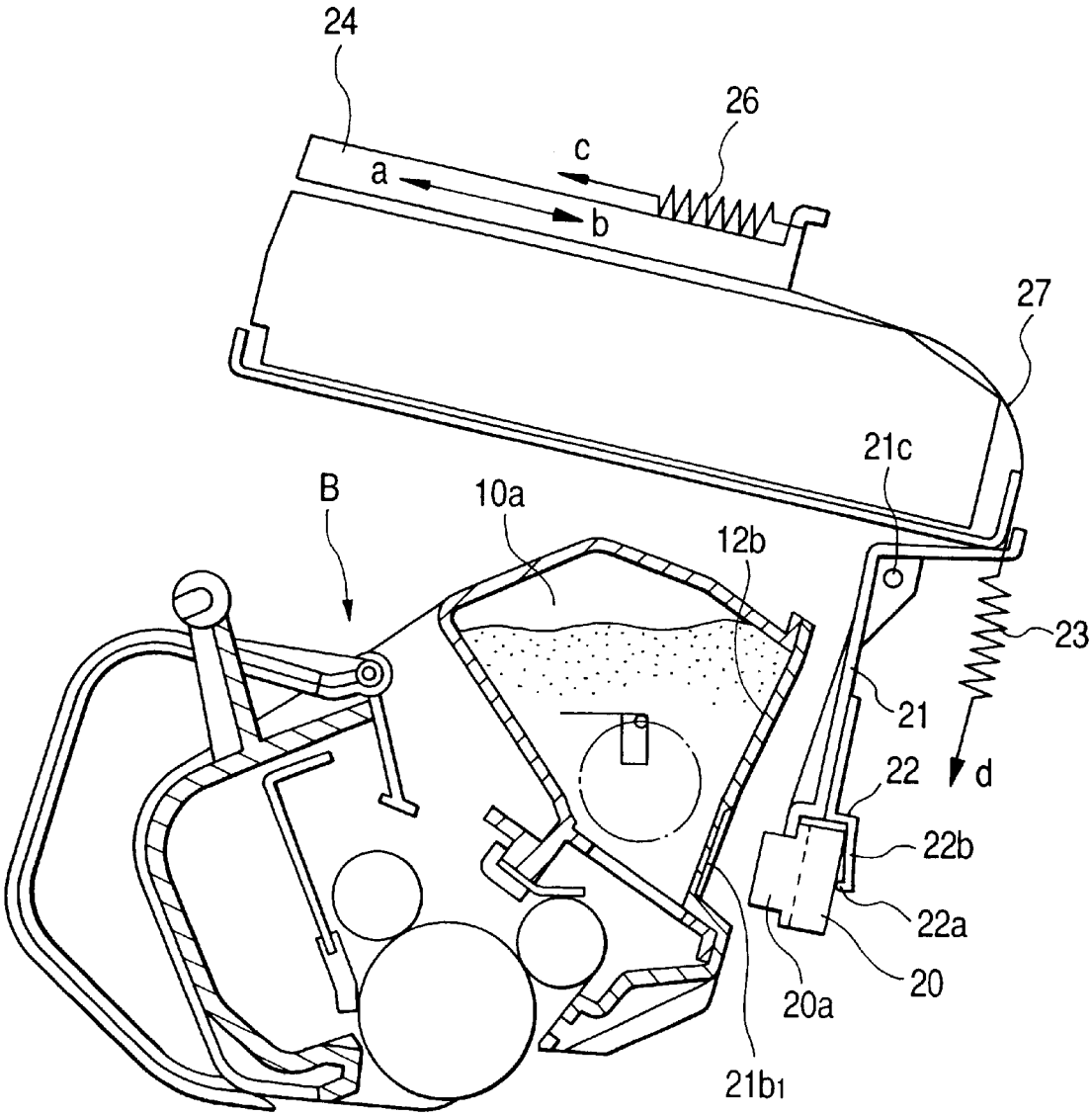
FIG. 11 is a explanatory view which illustrates the opened state of the opening and closing cover representing contact means of the magnetic bridge sensor.
Figure 12:
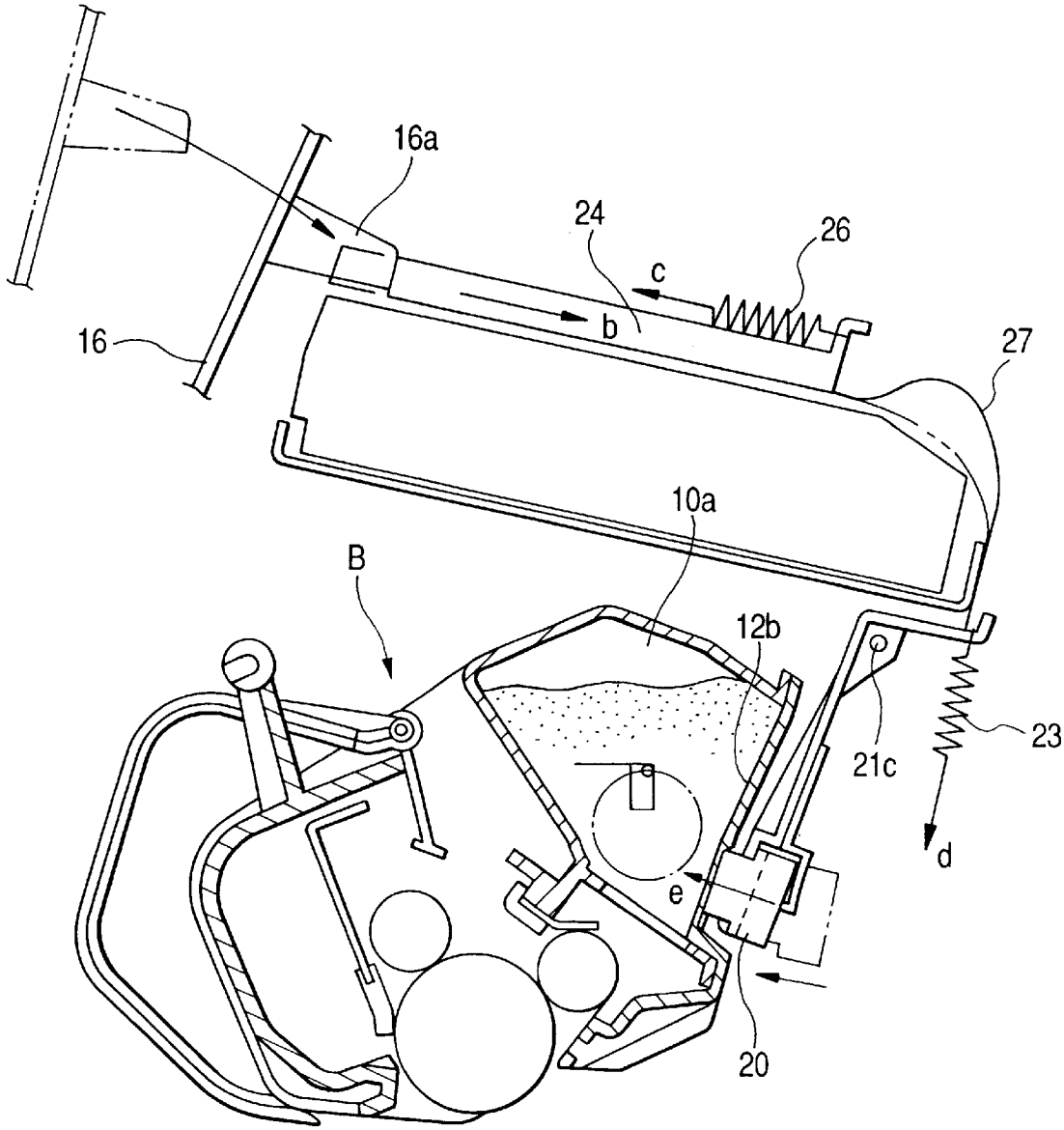
FIG. 12 is a explanatory view which illustrates the closed state of the opening and closing cover representing contact means of the magnetic bridge sensor.

Now, in conjunction with FIG. 11 and FIG. 12, the detailed description will be made of abutting means of the magnetic bridge sensor 20. FIG. 11 shows the open state of the opening and closing cover 16 (see FIG. 1). FIG. 12 shows the closed state of the opening and closing cover 16.

In FIG. 11, the interlocking member 24, which is movable in the directions indicated by arrows a and b while being interlocked with the operation of the opening and closing cover 16, provides tension for the connecting sheet (sheet member) 27 that connects the sensor holder 21 with the interlocking member 24 by means of the force of the interlocking spring (biasing spring) 26 whose one end is fixed to the interlocking member 24, and which is exerted in the direction indicated by an arrow c. Thus, the force of the interlocking spring 26 acts upon the sensor holder 21 to overcome the force of the biasing spring 23 in the direction indicated by an arrow d, thus restricting the swinging of the sensor holder 21 to enable the sensor holder 21 to rotate in the direction in which the magnetic bridge sensor 10 is allowed to part from the development wall member 12*b*. Here, in accordance with the present embodiment, the interlocking means comprises the interlocking member 24, the interlocking spring 26, and the connecting sheet 27.

In the open state of the opening and closing cover 16 as described above, the magnetic bridge sensor 20 is retracted from the position in which it abuts upon the development wall member 12*b*. It is possible to attach or detach the cartridge B without causing the detection surface 20*a*1 of the detection head 20*a* and the recessed portion 12*b*1 of the development wall member 12*b* to rub each other. Thus, the frictional wear of the contact surface is prevented to enhance the durability of the sensor 20 significantly against the repeated attachment and detachment of the cartridge B.

When the opening and closing cover 16 is closed, the rib portion 16*a* of the opening and closing cover 16 pushes the interlocking member 24 in the direction indicated by an arrow b by overcoming the biasing force of the interlocking spring 26 as shown in FIG. 12. Then, the magnetic bridge sensor 20 is caused by the biasing force of the biasing spring 23 that acts upon the sensor holder 21 to rotate in the direction indicated by an arrow e from the position indicated by the two-dot chain line, and as indicated by the solid line, the detection surface 20*a*1 of the detection head 20*a* abuts upon the recessed portion 12*b*1 of the development wall member 12*b,* hence making it possible to detect the presence or absence of developer in the toner chamber 10*a*. In this case, it is arranged to set the amount of movement of the interlocking member 24 larger than the amount of the rotation of the sensor holder 21 when the opening and closing cover 16 is completely closed. Thus, the biasing force of the interlocking spring 26 is prevented from acting upon the sensor holder 21 by the connecting sheet that may slacken.

In this manner, the magnetic bridge sensor 20 abuts upon the development wall member 12*b* only by an extremely stable contacting force exerted by the biasing force of the biasing spring 23 in order to implement a highly reliable detection of the presence and absence (amount of the remaining developer) of toner.

As readily understandable from the above description, in accordance with the embodiment of the developer detection apparatus and the image forming apparatus, there is provided an interlocking member that restricts the swinging of the holding member of the detection member while being interlocked with the open or closed condition of the opening and closing cover used for attaching or detaching the developer container to or from the main body, and when the opening and closing cover is open, the interlocking member restricts the swinging of the holding member, while allowing the holding member to swing against the biasing force of its biasing means, hence releasing the contact of the detection member with the developer container. Then, in the closed condition of the opening and closing cover, the interlocking member does not restrict the swinging of the holding member to allow the holding member to swing by use of the biasing means, and by causing the detection member to abut upon the developer container to enable them to be in contact with each other with an extremely stable contacting force, hence making it possible to perform a highly reliable detection of the presence and absence of developer or remaining developer. Then, while reducing the cost of manufacture, it is possible to enhance the durability of the detection member significantly.

What is claimed is:

1. A developer detection apparatus, comprising:

a detection member for detecting a developer contained in a developer container detachably mountable on a main body of an image forming apparatus;

a supporting member for supporting said detection member;

a biasing member for biasing with a biasing force said detection member to the developer container; and interlocking means for being interlocked with the open and close operations of an opening and closing cover for attaching the developer container to or detaching the developer container from the main body of the apparatus.

wherein when the opening and closing cover is in an open state, the interlocking means causes a force to act on said supporting member to position the detection member in a location so as not to abut on the developer container, and when the opening and closing cover is in a closed state, the interlocking means does not cause any force to act upon said supporting member so as to abut on the developer container by the biasing force of the biasing member.

2. A developer detection apparatus according to claim 1, wherein the supporting member supports the detection member movably with respect to the supporting member.

3. A developer detection apparatus according to claim 2, wherein said supporting member supports said detection member so as to enable a detection surface thereof to be inclined to said supporting member.

4. A developer detection apparatus according to claim 2, wherein said supporting member includes a pressure member for pressing elastically an opposite side of a detection surface of said detection member, and when the detection surface abuts upon the developer container, said detection member is made movable with respect to said supporting member against the pressure of said pressure member.

5. A developer detection apparatus according to claim 4, wherein said pressure member presses substantially on a central portion of an opposite side of the detection surface of said detection member.

6. A developer detection apparatus according to claim 1, wherein said detection member is a magnetic permeability sensor.

7. A developer detection apparatus according to claim 1, wherein said interlocking means comprises an interlocking member abutting upon said opening and closing cover; a biasing spring for biasing said interlocking member to abut upon the opening and closing cover; and a sheet member for connecting said interlocking member and the supporting member.

8. An image forming apparatus having a main body, said apparatus, comprising:

an opening and closing cover for attaching and detaching a developer container; and a developer detection apparatus including:

a detection member for detecting a developer contained in the developer container;

a supporting member for supporting said detection member;

a biasing member for biasing said detection member to the developer container side; and interlocking means for being interlocked with open and close operations of said opening and closing cover for attaching the developer container to or detaching the developer container from the main body of said apparatus, wherein when the opening and closing cover is in an open state, said interlocking means causes a force to act on said supporting member to position said detection member in a location so as not to abut on the developer container, and when said opening and closing cover is in a closed state, said interlocking means does not cause any force to act upon said supporting member so as to abut on the developer container by a biasing force of said biasing member.

9. An image forming apparatus according to claim 8, wherein said supporting member supports said detection member movable with respect to the supporting member.

10. An image forming apparatus according to claim 9, wherein said supporting member supports said detection member so as to enable a detection surface thereof to be inclined to said supporting member.

11. An image forming apparatus according to claim 9, wherein said supporting member comprises pressure member for pressing elastically an opposite side of a detection surface of said detection member, and when the detection surface abuts upon the developer container, said detection member is made movable with respect to said supporting member against the pressure of said pressure member.

12. An image forming apparatus according to claim 11, wherein said pressure member presses substantially a central portion of an opposite side of the detection surface of said detection member.

13. An image forming apparatus according to claim 8, wherein said detection member is a magnetic permeability sensor.

14. An image forming apparatus according to claim 8, wherein said interlocking means comprises an interlocking member abutting upon said opening and closing cover; a biasing spring for biasing said interlocking member to abut upon said opening and closing cover; and a sheet member for connecting said interlocking member and said supporting member.

* * * * *

UNITED STATES PATENT AND TRADEMARK OFFICE

CERTIFICATE OF CORRECTION

PATENT NO. : 6,148,156

DATED : November 14, 2000

INVENTOR(S) : Yasuhiro MATSUMOTO

It is certified that error appears in the above-identified patent and that said Letters Patent is hereby corrected as shown below:

COLUMN 1:

Line 66, "form" should read --from--.

COLUMN 2:

Line 31, "basing" should read --biasing--.

COLUMN 6:

Line 67, "tby" should read --by--.

COLUMN 9:

Line 9, "have" should read --has--;
Line 12, "reside" should read --resides--;
Line 18, "are" should read --is--; and
Line 46, "reside" should read --resides--.

COLUMN 11:

Line 60, "toners)" should read --toner).--.

UNITED STATES PATENT AND TRADEMARK OFFICE

CERTIFICATE OF CORRECTION

PATENT NO. : 6,148,156

DATED : November 14, 2000

INVENTOR(S) : Yasuhiro MATSUMOTO

It is certified that error appears in the above-identified patent and that said Letters Patent is hereby corrected as shown below:

COLUMN 12:

Line 29, "24" should read --14--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*